US005201371A

United States Patent [19]

Allen

[11] Patent Number: 5,201,371

[45] Date of Patent: Apr. 13, 1993

[54] BACK PRESSURE FLAPPER VALVE

[76] Inventor: Charles W. Allen, 4210 Sarah Street, New Iberia, La. 70560

[21] Appl. No.: 695,459

[22] Filed: May 3, 1991

[51] Int. Cl.[5] ..... E21B 34/08; F16K 15/03

[52] U.S. Cl. ..... 166/325; 137/527

[58] Field of Search ..... 137/527; 166/319, 325, 166/332, 334

[56] References Cited

U.S. PATENT DOCUMENTS

| | | | |
|---|---|---|---|
| 1,871,536 | 8/1932 | LeBus | 137/527 X |
| 3,016,914 | 1/1962 | Keithahn | 166/325 X |
| 4,230,150 | 10/1980 | Scaramucci | 137/527 |
| 4,605,041 | 8/1986 | Teumer | 137/527 |

FOREIGN PATENT DOCUMENTS

| | | | |
|---|---|---|---|
| 2718821 | 6/1978 | Fed. Rep. of Germany | 137/527 |
| 1448765 | 9/1976 | United Kingdom | 166/325 |

*Primary Examiner*—David J. Bagnell
*Attorney, Agent, or Firm*—John M. Harrison

[57] ABSTRACT

In an oil field tubular assembly, a flapper valve permitting downward flow and blocking upward flow is closed by down-hole pressure. A pivotally mounted flapper is urged to the closed position by a spring force, which may be moderated approaching the open position to reduce flow resistance, and an offset valve inlet passage provides clearance for flapper opening and room for the pivotal mounting.

7 Claims, 4 Drawing Sheets

BACK PRESSURE FLAPPER VALVE

TECHNICAL FIELD OF THE INVENTION

The present invention relates to the field of downhole back pressure containing valves as used in the oil field in assembly with hydraulic workover-snubbing or coil tubing operations to work under pressure, preventing well fluids and gases from flowing up the workstring, thus allowing pipe or coil tubing to be run or pulled from the well bore without killing the well and possibly damaging formations with kill fluids. The back pressure valve also serves as a safety valve when the pipe or the coil tubing is being pulled from the well bores having formation pressure in the tubing. For example, if a pinhole develops in the workstring or coil tubing the pinhole exposes well gases and fluids to the atmosphere when the pinhole is pulled above the stripper rubbers or the blow-out preventors. The back pressure valve then seals the workstring on the bottom and pressures are successfully bled off, allowing the pipe or coil tubing to continue safely out of the well bore without pollution from gases and well bore fluids blowing through the pin hole. The invention thus saves expensive time and labor which would normally be required to run the pipe with the pinhole back down to the bottom of the oil well bore and pump killing fluids into the well in order to remove the tubing. The back pressure flapper valve also operates to protect pumps and auxiliary equipment from damage by down-hole pressure surges when drilling or treating wells with pressurized fluids or mixtures.

BACKGROUND OF THE INVENTION

Oil well drilling requires the pumping of specially compounded drilling muds at high flow rates in order to bail cuttings from the hole and control formation pressures. Penetration of a formation at times may result in pressure surges known as kicks, which can damage the pump or related equipment, and are undesirable in any case. Ball type check valves can be included in the drilling pipe string for the purpose of controlling downhole back pressure, and such devices are effective in that regard. The necessity of fitting such a valve within the confines of the drilling pipe diameter compromises its fluid flow capacity so that increased mud pump pressure is required to overcome the restriction. This penalty tends to discourage the use of such valves.

Wells are also pressure treated with various special purpose fluids and mixtures on occasion, for remedial purposes such as stimulating production or extending the life of the well. The pressurized treatment medium may be a mud compound, cement, resin coated sand, gravel or some other material, depending upon the nature of the operation. Back pressure control requirements and the equipment used are much the same as for drilling practice, with similar compromises and limitations.

Flapper type valves such as the OTIS ENGINEERING CORPORATION "Series 10" and "Type Q" safety valves, are known to be used in production pipe strings where they are remotely controlled from the surface by hydraulic pressure. Other applications have been made of flapper type valves, used facing upwardly in the production pipe string, so as to allow free upward flow only. Prior to the instant invention however, no down hole pressure actuated flapper-type safety valve has been known to the industry.

The ball type check valves known to the art are capable of rapid closure during a pressure kick. It is an object of the present invention to retain this rapid response while providing an improved flow path compared to that of a ball type valve and thus a relatively low pressure drop. This reduced pressure resistance allows pumping of stiffer, more viscous mixtures by reducing the necessary pumping pressure and can also improve pump life. It is also an object to provide the valve of the present invention in a form adaptable to the various tubing and pipe diameters and to the different joint thread standards used in the industry.

DESCRIPTION OF THE DRAWINGS

The aforementioned and other objects and features of the invention will be apparent from the following detailed description of specific embodiments thereof, when read in conjunction with the accompanying drawings, in which.

DETAILED DESCRIPTION OF THE INVENTION

Figure 1:
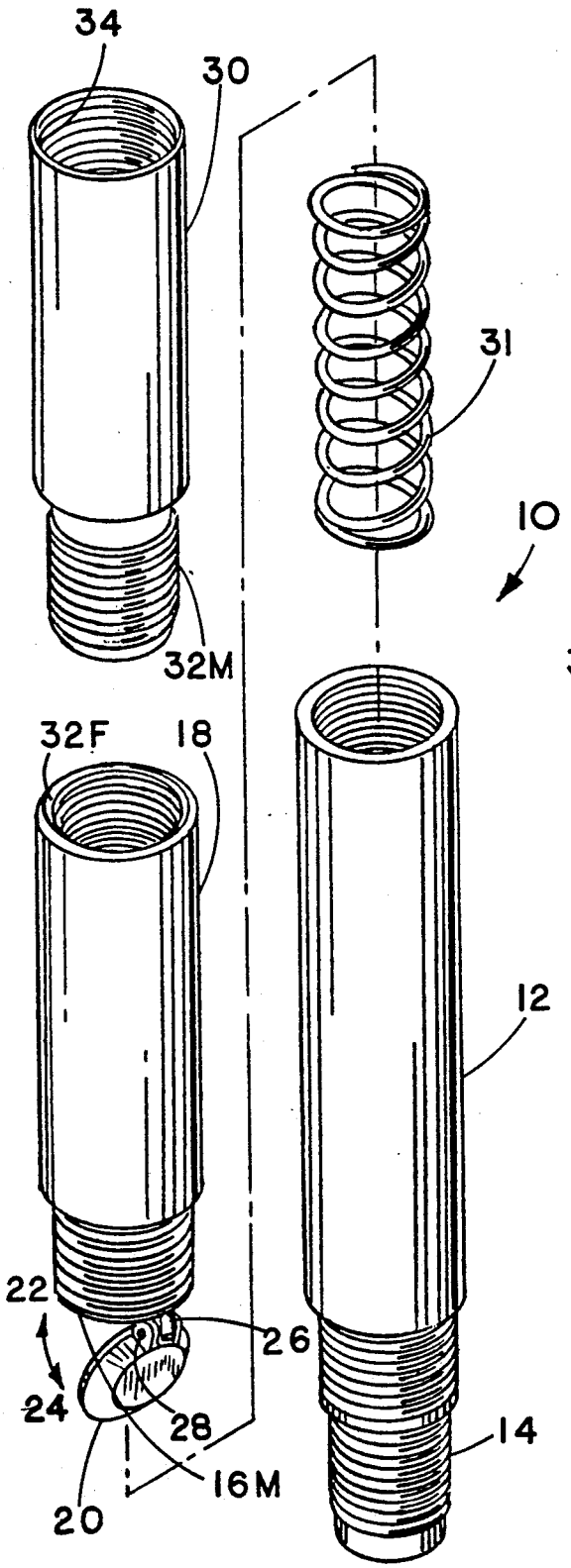
FIG. 1 shows an exploded view of a first preferred embodiment of the invention.
Figure 2:
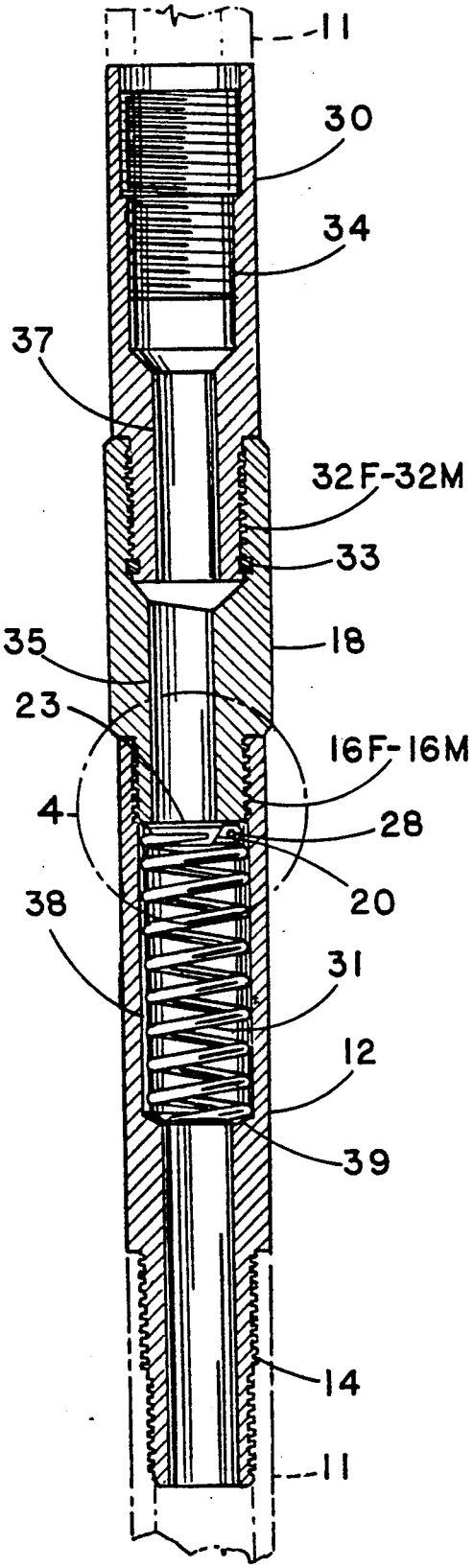
FIG. 2 shows a cross section view of the assembly of FIG. 1.

Referring now to FIGS. 1 and 2 of the drawings, there are shown exploded and assembled views of the valve assembly 10 of the present invention as interposed in string 11. In this case, spring housing 12 has a HYDRIL 2-step threaded pin 14 to match the connections used in string 11, and a standard straight thread 16F for assembly with mating thread 16M of valve sub 18. Valve sub 18 has flapper mounting lug 26 attached at the periphery of sealing surface 23 for the pivotal connection of flapper 20. An assembly pin 28 provides this connection, allowing the flapper to pivot from the closed position indicated by arrow 22 to an open position as indicated by arrow 24. Valve sub 18 has a standard straight thread 32F at its upper end for assembly to an adaptor sub 30, which has mating thread 32M and a HYDRIL 2-step threaded box 34 to match the connections used in string 11. Sealing of connection 32F-32M is augmented by seal packing 33.

Upon assembly, coil spring 31 fits freely inside of flapper bore 38, seating on shoulder 39 and bearing against flapper 20 in a lightly compressed state. Flapper 20 is thus urged to the closed position indicated by arrow 22. The length of assembly pin 28 fits closely within the wall of flapper bore 38 for positive retention. In this embodiment, the reduced internal diameter valve inlet 35 is offset from the concentric internal bore 37 of adaptor sub 30, and from the similarly concentric flapper bore 38, in order to provide more clearance outside of sealing surface 23 for the location of flapper mounting lug 26 and more swing clearance for opening of flapper 20.

Figure 3:
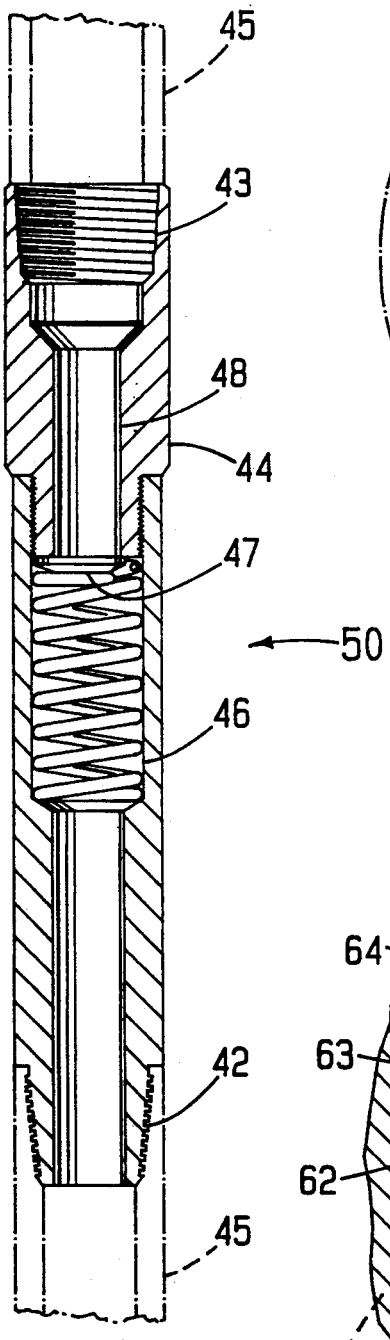
FIG. 3 shows a cross section view of an alternate form of the embodiment of FIG. 1 with concentric diameters.

In FIG. 3 is shown an alternate assembly 50, of the embodiment of FIG. 1, which illustrates its adaptability. Here are furnished the standard tapered thread pin 42 and tapered thread box 43 connections required for installation in pipe string 45. Also in assembly 50, the reduced diameter valve inlet 48 of valve sub 44 is seen to be coaxial with the concentric flapper bore 46 and pipe string 45. The selection of coaxial or offset design is optional, but it should be considered that if offset, the reduced diameter valve inlet 48 could be larger and, in the manner of following FIG. 8, flapper 47 would be cleared to open more fully and both would reduce back pressure.

Figure 4:
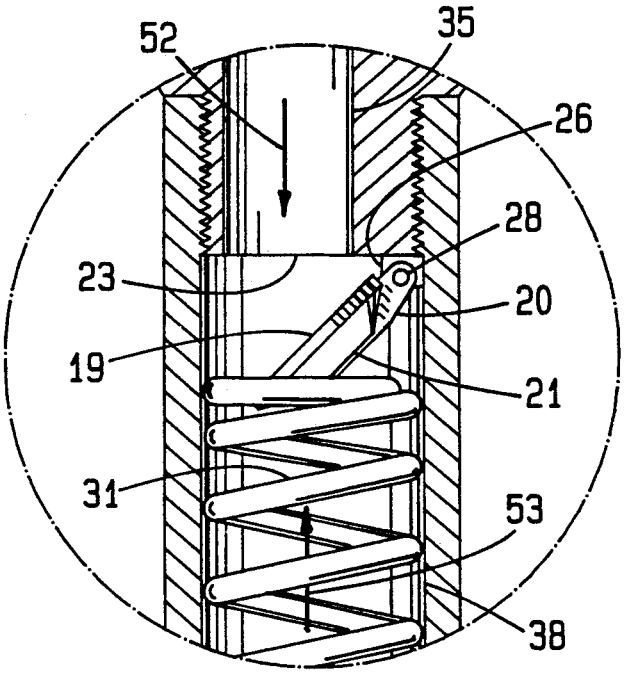
FIG. 4 shows a detail section view of the embodiment of FIG. 1 during passage of downward flow.

In FIG. 4 is shown a detailed view of the circled portion 4 of FIG. 2, illustrating the opening operation of flapper 20 previously indicated by arrow 24. Downward flow 52, through valve inlet 35, pushes under face 21 of flapper 20 against coil spring 31 which is compressed. The sealing face 19 is lifted from sealing surface 23 and flow 53 passes on through flapper bore 38. It is clearly seen that a reverse flow 54 will impinge upon lower face 21 and, along with the force of spring 31, will quickly return flapper 20 to the closed position indicated by arrow 22 in FIG. 1. In this position, sealing face 19 fits tightly against sealing surface 23, stopping flow 53 along with any associated pressure surge.

Figure 5:
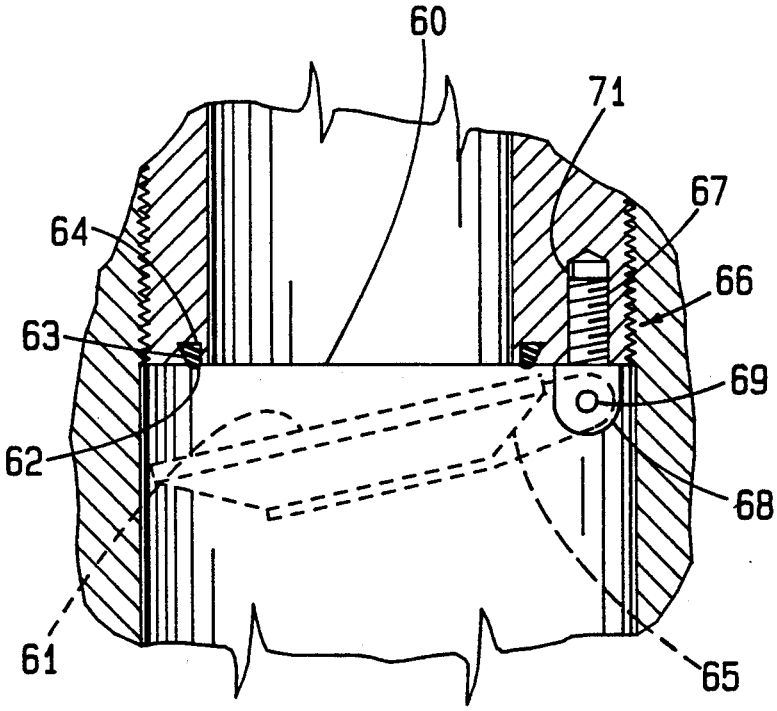
FIG. 5 shows a detail section view of a gasketed sealing surface.

An improved sealing surface 60 is shown in FIG. 5, achieved by the addition of resilient sealing ring 62, which may be a standard "0" rings, in seal retaining groove 64. The outer wall 63 of retaining groove 64 is undercut, and sealing ring 62 must be deformed upon installation, which holds it in place in service. Retaining groove 64 is sized so that sealing ring 62 protrudes slightly beyond sealing surface 60, affording more perfect contact with sealing face 61 upon closure. In addition to better sealing, with more latitude for manufacturing tolerances, the sealing ring 62 provides a degree of cushioning for the rapid closure of flapper 65.

FIG. 5 also shows the preferred construction of mounting lug 66 as a screw-in attachment with a flattened head 68. The flattened head 68 receives assembly pin 69 while the threaded body 67 is installed in receiving threads 71, which are tapped outside of seal retaining groove 64.

Figure 6:
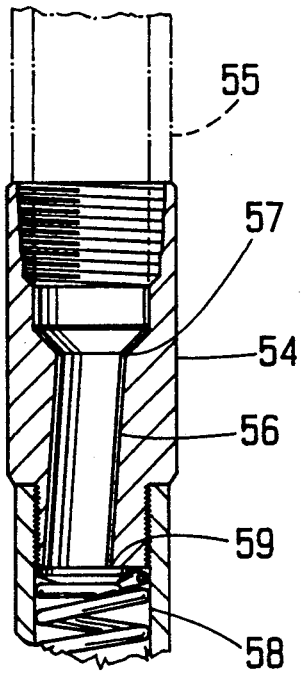
FIG. 6 shows an alternate offset form in a valve sub fitting the embodiment of FIG. 3.

In FIG. 6 is shown an alternate valve sub 54 wherein valve inlet 56 is inclined, being concentrically placed at upper end 57 with respect to pipe string 55, but offset at lower end 59 with respect to flapper bore 58. The functional result is effectively that provided by the offset inlet 35 of FIG. 2, but with slightly less flow disturbance and hence somewhat less pressure drop.

Figure 7:
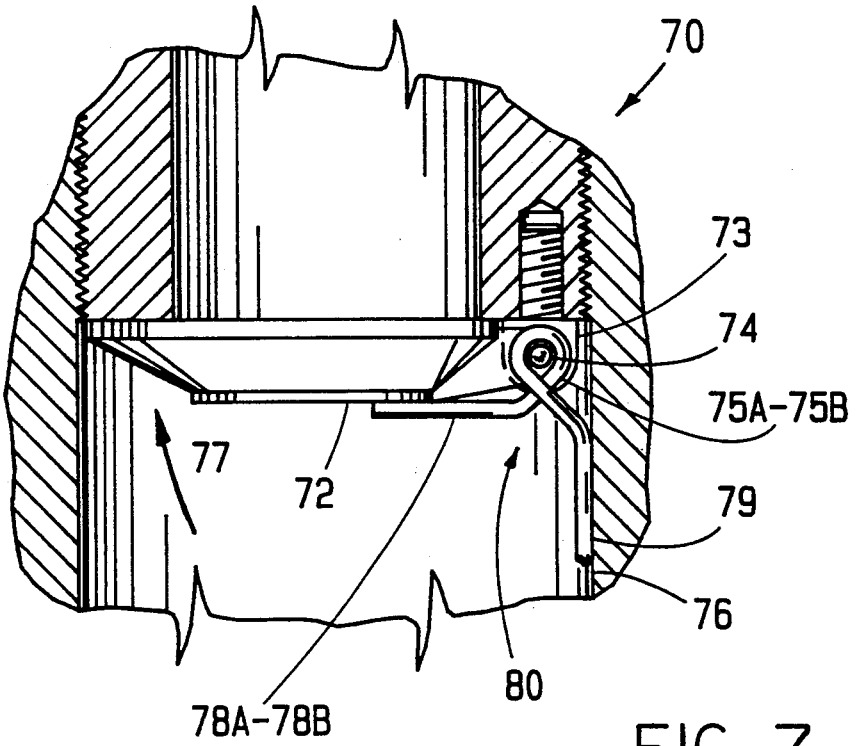
FIG. 7 shows a detail view of an alternate embodiment having a torsional closing spring.

In FIG. 7 is shown an alternate flapper assembly 70 with the flapper 72 connected to mounting lug 73 by assembly pin 74. Torsional spring 80 is a symmetrical part with two active arms 78A and 78B, on either side of mounting lug 73, and "U"-shaped anchor arm 79 which bears against flapper bore 76. Anchor arm 79 transitions into coils 75A and 75B which encircle the extended ends of assembly pin 74 on either side of mounting lug 73 and continue to form active arms 78A and 78B. Torsional spring 80 is deflected slightly on assembly so as to create a force for holding flapper 72 in the closed position shown, and as flapper 72 pivots toward the open position indicated by arrow 77 the closing force is increased.

Figure 8:
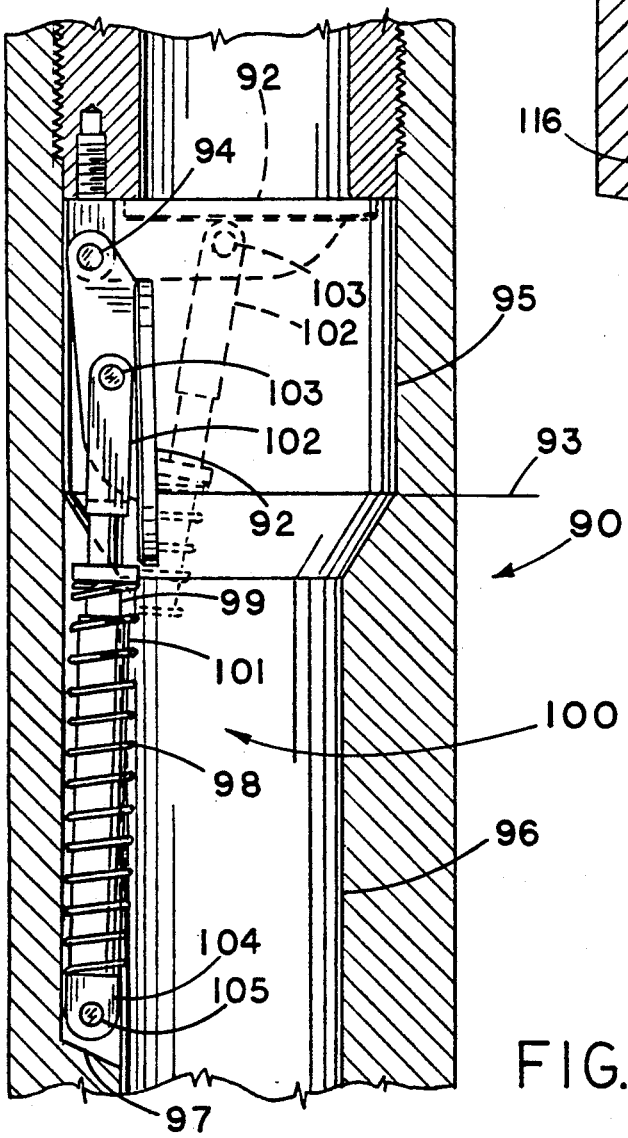
FIG. 8 shows a detail view of a second preferred embodiment having a reduced closing force when fully open.

In FIG. 8 is shown a second preferred embodiment 90 which includes flapper 92 connected for pivotal movement on assembly pin 94. Flapper bore 95 is enlarged to depth 93, providing clearance to accept movement of flapper 92 to the open position as shown, and the lower adjacent internal diameter 96 is reduced somewhat. Compression spring 98 is fitted to telescoping spring guide assembly 100, comprising telescoping member 99 and tubular housing 101. Telescoping member 99 has a clevis end fitting 102 for connection to flapper 92 by means of clevis pin 103. Pad eye 104, at the opposite end of tubular housing 101, is fitted into recess 97 in the wall of lower diameter 96 by means of through pin 105 which may be retained by means not shown such as sealant or pipe plugs.

Through pin 105 and clevis pin 103 are located so as to approach, but not come into alignment with, assembly pin 94. In this manner, even though spring 98 exerts a greater force when compressed by the opening of flapper 92, the net closing force thereon is reduced, but still adequate for closure.

Figure 9A:
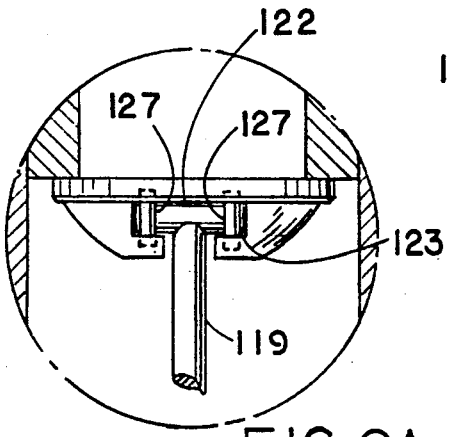
FIG. 9A shows a detail view of the third preferred embodiment.
Figure 9:
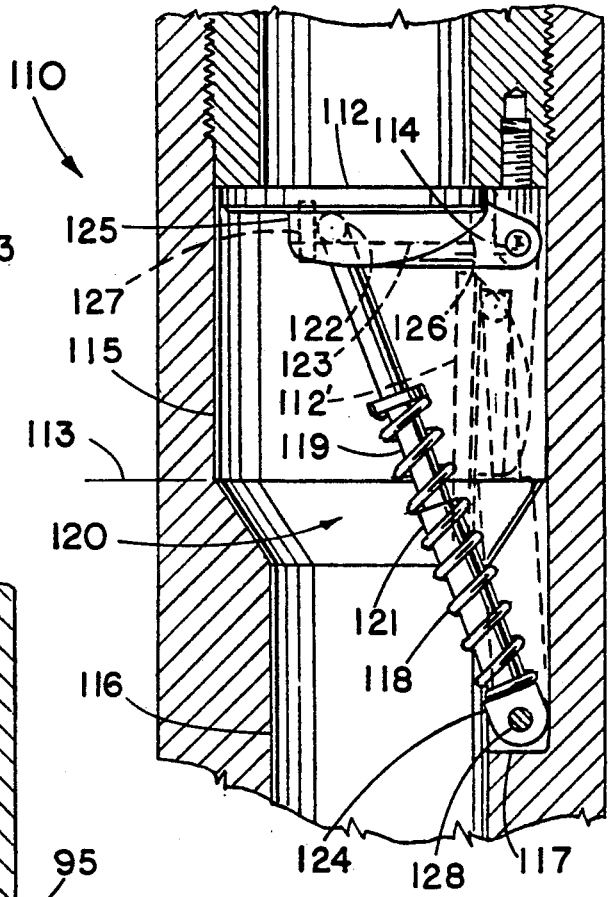
FIG. 9 shows a view of a third preferred embodiment. having a reduced closing force when fully open.

FIGS. 9 and 9A show a third preferred embodiment 110 which includes flapper 112 connected for pivotal movement on assembly pin 114. Flapper bore 115 is enlarged to depth 113, providing clearance to accept movement of flapper 112 to the open position as shown, and the lower adjacent internal diameter 116 is reduced somewhat. Compression spring 118 is fitted to telescoping spring guide assembly 120, comprising telescoping member 119 and tubular housing 121. Telescoping member 119 has a sliding end fitting 122 for connection to flapper 112 by means of retaining groove 123. End fitting 122 fits closely in retaining groove 123, but can move pivotally and slide longitudinally therein. The longitudinal movement is limited by stop pins 127 at the open end 125 of retaining groove 123 and by groove end 126 in the opposite direction. Pad eye 124, at the opposite end of tubular housing 121, is fitted into recess 117 in the wall of lower diameter 116 by means of through pin 128 which may be retained by means not shown such as sealant or pipe plugs.

When flapper 112 is in the closed position as shown, sliding end fitting 122 is moved away from assembly pin 114 to bear against stop pins 127. In this manner, spring 118 is favorably positioned to hold flapper 112 so that only a light force is needed. As flapper 112 moves to the open position indicated as 112', sliding end fitting 122 moves toward assembly pin 114 to bear against closed groove end 126. Through pin 128 and groove end 126 are located so as to allow through pin 128 and sliding end fitting 122 to approach, but not come into alignment with, assembly pin 114. In this manner, spring 118 is not so severely compressed by the full opening of flapper 112 so that the length thereof may be relatively short. The force of spring 118 is applied with reduced leverage so that the net closing force on flapper 112 is reduced, but again adequate for closure.

The valve opening of the first embodiment, although less full than shown to be achieved with the alternate embodiments, represents an improved flow capacity relative to the existing ball-type valves. The full opening second and third preferred embodiments, and the torsional spring alternative, provide a yet greater improved flow capacity. In any case, the valve opening increases with flow until back pressure induced by the flapper balances the spring force urging it to close. As the flapper approaches a fully open position, this induced back pressure falls to a minimum. The coil spring of the first embodiment, as well as the torsional spring alternative, give rise to progressively increasing closing force as the valve opening increases, thus the valve opening is always less than ideal in actual practice. The reduced valve closing force, as disclosed in the second and third embodiments permits the valve to achieve a virtually full opening without the need for significant added back pressure to overcome spring force.

It will be understood that the invention is not limited to the disclosed embodiments, but is capable of rearrangement, modification and substitution of parts and elements without departing from the spirit of the invention.

Having thus described my invention, I claim:

1. A flow actuated one way valve for free downward and blocked upward flow operation in oil well tubular assemblies comprising: tubular members of nominally uniform outside diameter for insertion in the oil well tubular assemblies, said tubular members provided with a reduced internal diameter portion above an adjacent enlarged internal diameter portion;

a downwardly-facing circumferential sealing surface adjoining said reduced internal diameter;

mounting means provided outwardly adjacent said circumferential sealing surface, for providing a pivotal axis located outside of said reduced internal diameter and in a plane substantially perpendicular thereto;

a flapper having an upwardly-oriented sealing face and an under face, said flapper pivotally mounted to said mounting means for movement from a first position with said sealing face closely contacting said sealing surface, to a second position substantially disposed between said reduced and enlarged internal diameters; and a compression spring having coils closely fitting within said adjacent enlarged diameter for free coaxial movement therein for applying a closing force to urge said sealing member to said first position.

2. The flow actuated one way valve of claim 1 wherein said reduced and enlarged diameters are coaxial.

3. The flow actuated one way valve of claim 1 further comprising;

an offset of the downward end of said reduced diameter with respect to said adjacent enlarged diameter; and placement of said mounting means proximal the zenith of said offset.

4. The flow actuated one way valve of claim 1 further comprising:

a continuous seal-retaining groove of substantially uniform cross-section and depth, cut in said circumferential sealing surface to surround said reduced diameter and lie fully in the area contacted by said flapper, said uniform cross-section comprising a first wall substantially perpendicular to said sealing surface, a base surface parallel to said sealing surface, and a second wall inclined relative to said sealing surface so that groove width increases with depth; and a continuous resilient sealing element filling said seal-retaining groove so that a continuously uniform portion of said sealing element extends from said groove and past said sealing surface.

5. A flow actuated one way valve for free downward and blocked upward flow operation in oil well tubular assemblies comprising:

a pair of threadably connected tubular members of uniform outside diameter with a reduced internal diameter portion provided in one of said tubular members above an adjacent enlarged internal diameter portion provided in the other of said tubular movement;

an adaptor having one end threadably engaging said one of said tubular members and the opposite end of said adaptor adapted for threadably engaging the oil well tubular assemblies;

a downwardly-facing circumferential sealing surface adjoining said reduced internal diameter in said one of said tubular members;

a flapper having an upwardly oriented sealing face and an under face, pivotally mounted for movement from a first position, with said sealing face closely contacting said sealing surface, to a second position substantially disposed between said reduced and enlarged internal diameters;

mounting means provided adjacent said circumferential sealing surface for receiving said flapper and effecting pivotal movement of said flapper between said first position and said second position, wherein the pivotal axis of such movement is located outside of said reduced internal diameter in a plane substantially perpendicular thereto;

an assembly pin at said pivotal axis; and a torsional spring held in place by said assembly pin, said torsional spring having an active arm urging said flapper to said first position and an anchor arm bearing against the body of said tubular assembly.

6. A flow actuated one way valve for free downward and blocked upward flow operation in oil well tubular assemblies comprising:

a pair of threadably connected tubular members of uniform outside diameter with a reduced internal diameter portion provided in one of said tubular members above an adjacent enlarged internal diameter portion provided in the other of said tubular members;

a downwardly-facing circumferential sealing surface adjoining said reduced internal diameter in said one of said tubular members;

a flapper having an upwardly oriented sealing face and an under face, pivotally mounted for movement from a first position, with said sealing face closely contacting said sealing surface, to a second position substantially disposed between said reduced and enlarged internal diameters;

mounting means provided adjacent said circumferential sealing surface for receiving said flapper and effecting pivotal movement of said flapper between said first position and said second position wherein the pivotal axis of such movement is located outside of said reduced internal diameter in a plane substantially perpendicular thereto;

a compression spring seated in said other of said tubular members and having a first end and a second end and active along a line defined by said first end and said second end;

a straight retaining groove of substantially uniform cross-section along the lower side of said flapper and perpendicular to said pivotal axis;

a sliding member confined by said straight retaining groove for movement toward and away from said pivotal axis;

means for connecting said the first end of said compression spring to said sliding member so as to allow movement of said flapper between said first position and said second position;

outer stop means for limiting the movement of said sliding member away from said pivotal axis so as to stay within the periphery of said flapper in said first position;

inner stop means for limiting the movement of said sliding member toward said pivotal axis so as to stay within the periphery of said flapper in said second position; and connecting means radially angularly aligned with said mounting means for connecting said second end proximate said enlarged internal diameter so that said spring is partially compressed when said flapper is in said first position and the extended line of action approaches said pivotal axis as said flapper moves to said second position.

7. The flow actuated one way valve of claim 6 further comprising an adaptor having one end threadably engaging said one of said tubular members and the opposite end of said adaptor adapted for threadably engaging the oil well tubular assemblies.

* * * * *